US006393958B1

(12) United States Patent
Owens et al.

(10) Patent No.: US 6,393,958 B1
(45) Date of Patent: May 28, 2002

(54) MITRE BOX

(75) Inventors: Robert L. Owens, Southington; Eduardo J. Jimenez, Avon; George Matyczyk, Southington, all of CT (US)

(73) Assignee: The Stanley Works, New Britain, CT (US)

( * ) Notice: Subject to any disclaimer, the term of this patent is extended or adjusted under 35 U.S.C. 154(b) by 0 days.

(21) Appl. No.: 09/373,730

(22) Filed: Aug. 13, 1999

(51) Int. Cl.[7] ..... B26D 7/01; B26D 7/26

(52) U.S. Cl. ..... 83/762; 83/468; 83/581; 144/286.1; 144/286.5; 269/16

(58) Field of Search ..... 83/762, 821, 581, 83/468, 761, 745; 144/286.1, 286.5; 269/16

(56) References Cited

U.S. PATENT DOCUMENTS

| | | | | |
|---|---|---|---|---|
| 3,651,840 A | | 3/1972 | Ridenour | |
| 3,782,235 A | | 1/1974 | Curcio | |
| 3,935,779 A | | 2/1976 | Hildebrandt et al. | |
| 4,158,523 A | * | 6/1979 | Schotzko | 83/761 |
| 5,050,652 A | * | 9/1991 | Bumpus | 269/16 |
| 5,279,198 A | | 1/1994 | Cross | |
| D371,301 S | * | 7/1996 | Jacoff | 83/762 |
| 5,577,430 A | | 11/1996 | Gunderson et al. | |
| 5,813,306 A | | 9/1998 | Jacoff | |

FOREIGN PATENT DOCUMENTS

| | | |
|---|---|---|
| DE | 19808357 | 8/1998 |
| DE | 29803756 | 8/1999 |
| DE | 29809447 | 11/1999 |
| SE | 451813 | 11/1987 |

* cited by examiner

*Primary Examiner*—M. Rachuba
(74) *Attorney, Agent, or Firm*—Pillsbury Winthrop LLP

(57) ABSTRACT

The present invention relates to a mitre box that is used to guide a saw through a series of cutting strokes as it cuts through a workpiece during a workpiece cutting operation. One aspect of the invention relates to a mitre box that has a pair of aligned slots that extend 90° with respect to the edge of the workpiece, a pair of aligned slots that extend 45° with respect to the edge of the workpiece, and a pair of aligned slots that extend 67½° with respect to the edge of the workpiece. Another aspect of the invention relates to a mitre box that has an open elongated well for temporarily storing a marking tool during the cutting operations. Another aspect of the invention relates to a molded plastic mitre box that has a storage space extending below the workpiece supporting surface of the base for temporarily storing the saw between cutting operations. Yet another aspect of the invention relates to a mitre box that has a storage space for temporarily storing the saw below the workpiece supporting surface and a releaseable locking member for keeping the saw in the storage space.

16 Claims, 6 Drawing Sheets

MITRE BOX

FIELD OF THE INVENTION

The present invention relates to a mitre box for use in conjunction with a saw during a cutting operation wherein a cutting edge of the saw is engaged with a workpiece and moved through a series of cutting strokes to cut into and through the workpiece.

BACKGROUND AND SUMMARY OF THE INVENTION

When using a mitre box and saw for cutting through a workpiece, it is the usual practice to mark the workpiece with a marking tool, such as a pen or pencil, at the point where the cut is to be made. In situations where a high number of cuts are to be made, it is often necessary to repeatedly mark and cut workpieces, which results in the marking tool being set aside after making each mark. This creates the potential for the marking tool to be misplaced or dropped.

To make repeated marking and cutting operations easier and more efficient, one aspect of the present invention provides a mitre box for use in conjunction with a saw during a cutting operation wherein a marking tool is used to form a marking on a workpiece and a cutting edge of the saw is engaged with the workpiece along the marking and moved through a series of cutting strokes to cut into the workpiece. The mitre box comprises a base having a workpiece supporting surface that supports the workpiece during the aforesaid cutting operation and an abutment structure that provides a workpiece edge abutting surface against which an edge of the workpiece abutted against when placed on the workpiece supporting surface of the base. The box also comprises saw guiding structure having saw guiding surfaces. The saw guiding structure is constructed and arranged such that, when the workpiece is placed on the workpiece supporting surface with the edge thereof abutted against the workpiece abutting surface, the aforesaid workpiece cutting operation can be performed by disposing the saw between the saw guiding surfaces, engaging a cutting edge of the saw with the workpiece, and then moving the saw through a series of cutting strokes with said saw guiding surfaces guiding the saw at an angle with respect to the abutted edge of the workpiece that is determined by an orientation of said saw guiding surfaces. The box also comprises a well defining structure defining an elongated open well that extends into the well defining structure to an extent sufficient to enable the marking tool used to form markings during the aforesaid cutting operation to be temporarily stored within the open well and removed therefrom for marking the workpiece.

Additionally, in conventional mitre boxes, the cutting slots provided only allow the cuts to be made at 90° and 45° with respect to the workpiece edge. Although these two angles are the ones most commonly used in carpentry, it is often necessary to make cuts at other angles. In particular, it is sometimes desired to cut the workpiece at 22½° with respect to the transverse direction of the workpiece (i.e. 67½° with respect to the edge of the workpiece). This particular angle is often used in detail work for aesthetic purposes. However, no known mitre boxes provide the slots necessary to make such a cut.

Accordingly, another aspect of the present invention provides a mitre box for use during a cutting operation wherein a saw is moved through a series of cutting strokes to cut into the workpiece. The mitre box comprises a base having a workpiece supporting surface, a first slot defining structure having first, second, and third saw receiving slots extending through the first slot defining structure, and a second slot defining structure having first, second, and third saw receiving slots extending through the thickness of the second slot defining structure and being substantially aligned with the first, second, and third saw receiving slots of the first slot defining structure, respectively. Each of slots of the slot defining structures have a width suitable for receiving the saw and guiding the saw as it is moved through the series of cutting strokes during the aforesaid cutting operation.

An abutment structure provides a workpiece edge abutting surface. The abutment structure is constructed and arranged with respect to the first and second slot defining structures such that the workpiece can be placed on the workpiece supporting surface between the first and second slot defining structures and an edge of the workpiece can be abutted against the workpiece abutting surface with the substantially aligned first saw receiving slots of the first and second slot defining structures extending at about 90° with respect to the abutted edge of the workpiece, the substantially aligned second saw receiving slots of the first and second slot defining structures extending at about 45° with respect to the abutted edge of the workpiece, and the substantially aligned third saw receiving slots of the first and second slot defining structures extending at about 67½° with respect to the abutted edge of the workpiece. The abutment structure and the first and second slot defining structures enable the aforesaid cutting operation to be performed when the workpiece is placed on the workpiece supporting surface with the edge of the workpiece abutting the workpiece edge abutting surface by (a) inserting the saw into a selected pair of the substantially aligned saw receiving slots so that a cutting portion of the saw is engaged with the workpiece and extending at a selected angle with respect to the edge of the workpiece that is determined by the selected pair of the substantially aligned slots, and (b) then moving the saw through a series of cutting strokes with the selected pair of substantially aligned slots guiding through its cutting strokes so that cutting edge of the saw cuts into the workpiece at the aforesaid selected angle.

Another aspect of the present invention relates to the manner in which the cutting saw is stored. Typical mitre boxes have two upright walls. Normally, the saw is stored simply by laying it flat between the two walls. While the walls serve to cover the saw teeth and protect persons from cutting themselves while the box is stationary, this arrangement is not particularly suitable for transporting the box and saw together. Specifically, the person carrying the box must be sure to hold the saw in place during transport. Thus, there exists a need for a mitre box that allows for easy and safe transport of the box and saw together.

To meet this need, yet another aspect of the invention provides a molded plastic mitre box for use in conjunction with a saw during a cutting operation. The mitre box comprises a molded plastic base having a workpiece supporting surface. The molded plastic base includes integrally molded structure that defines a generally upwardly facing saw supporting surface and a storage space extending below the workpiece supporting surface of the base. The storage space and the saw supporting surface are configured to enable the saw to be temporarily stored in the space supported by the saw supporting surface between cutting operations so as to allow the mitre box and saw to be transported together between work locations with the saw in the storage space. A first slot defining structure has a saw receiving slot extending through a thickness thereof the first slot defining structure and a second slot defining structure has a saw receiving slot extending through a thickness thereof. The slots have a width suitable for receiving the saw and guiding the saw as it is moved through its series of cutting strokes. An abutment structure provides a workpiece edge abutting surface and is constructed and arranged with respect to the first and second slot defining structures such that the workpiece can be placed on the workpiece supporting surface between the first and second slot defining structures and an edge of the workpiece can be abutted against the workpiece abutting surface with the substantially aligned saw receiving slots of the first and second slot defining structures extending at an angle with respect to the abutted edge of the workpiece. The abutment structure and the first and second slot defining structures also enable the aforesaid cutting operation to be performed when the workpiece is placed on the workpiece supporting surface with the edge of the workpiece abutting the workpiece edge abutting surface by (a) removing the saw from the storing space, (b) then inserting the saw into the substantially aligned saw receiving slots so that a cutting portion of the saw is engaged with the workpiece in alignment with the marking thereon and extends at the angle determined by the substantially aligned slots with respect to the edge of the workpiece, and (c) then moving the saw through a series of cutting strokes with the selected pair of substantially aligned slots guiding through its cutting strokes so that cutting edge of the saw cuts into the workpiece at the aforesaid selected angle.

A related aspect of the invention provides a mitre box comprising a base having a workpiece supporting surface, a first slot defining structure having a saw receiving slot extending through a thickness thereof, and a second slot defining structure having a saw receiving slot extending through a thickness thereof. The base provides a storage space extending below the workpiece supporting surface of the base for temporarily storing the saw between cutting operations with the handle of the saw exposed, the storage space having an opening that allows for insertion and removal of the saw into and from the storage space. A releasable saw retaining structure associated with the opening of the saw storage space is constructed and arranged such that, when the saw is temporarily stored in the storage space, the saw retaining structure engages the saw so as to releasably retain the saw in the storage space in such a manner to allow the saw and box to be carried together by manually grasping the saw handle. The saw retaining structure is also constructed and arranged such that, when the saw is temporarily stored in the storage space and it is desired to remove the saw therefrom, the saw retaining structure can be moved to a releasing position wherein the saw retaining structure is disengaged from the saw so as to permit removal of the saw from the storage space through the opening. This aspect of the invention may be practiced with any type of mitre box and is not limited to the molded one illustrated.

Other objects, features, and advantages of the present invention will become apparent from the following detailed description, the accompanying drawings, and the appended claims.

DETAILED DESCRIPTION OF THE PREFERRED EMBODIMENTS OF THE INVENTION

Figure 1:
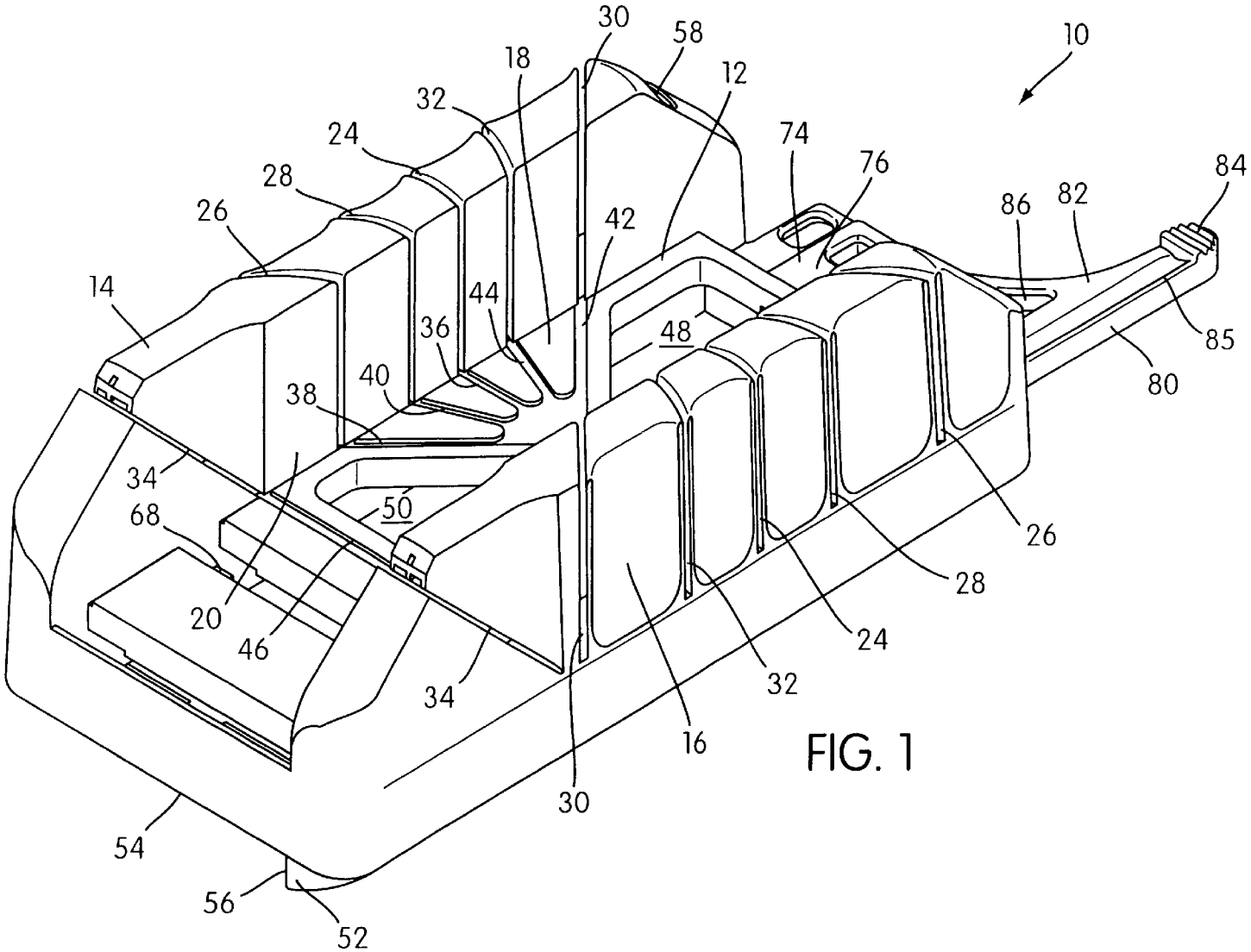
FIG. 1 is a perspective view of a mitre box constructed in accordance with the principles of the present invention.

FIG. 1 shows a perspective view of a mitre box, generally indicated at 10, constructed in accordance with the principles of the present invention. The mitre box 10 is injection molded and comprises a generally rectangular base 12 and a pair of generally parallel walls 14,16 extending upwardly from opposing sides of the base 12. The base 12 provides a generally upwardly facing, generally planar workpiece supporting surface 18 and the lower, inner sides of each of the walls 14,16 provide abutment structures that define generally straight abutment surface 20,22.

Each of the walls 14,16 has a series of slots formed therein, each of the slots having a width suitable to receive the blade of a saw. Specifically, the walls 14,16 define a set of aligned first slots 24, a set of aligned second slots 26, a set of aligned third slots 28, a set of aligned fourth slots 30, a set of aligned fifth slots 32, and a set of aligned sixth slots 34. The aligned first slots 24 extend generally perpendicularly with respect to the workpiece supporting surface 18 and at about 90° with respect to the abutment surfaces 20,22. The aligned second slots 26 and the aligned fourth slots 30 extend generally perpendicularly with respect to the workpiece supporting surface 18 and at about 45° with respect to the abutment surfaces 20,22. The aligned third slots 28 and the aligned fifth slots 32 extend generally perpendicularly with respect to the workpiece supporting surface 18 and at about 67½° with respect to the abutment surfaces 20,22. Finally, the aligned sixth slots 34 extend generally perpendicularly with respect to the abutment surfaces 20,22 and at about 45° with respect to the workpiece supporting surface 18.

In a broad sense, these walls 14,16 may be considered slot defining structures because they function to provide the sets of aligned slots. However, such slot defining structures do not necessarily have to be walls. For example, the spaced apart slot defining posts shown in U.S. Pat. No. 3,935,779, the entirety of which is hereby incorporated into the present application by reference, may be used instead. In addition, the term abutment structure can be considered to cover the disclosed preferred construction wherein the structure that provides the abutment surfaces are integral with the structures that provide the saw receiving slots (i.e. the walls) or it can be considered to cover arrangements wherein the structure that provides the abutment surfaces are spaced or otherwise separate from the structure that provides the saw receiving slots.

The base 12 has a series of grooves formed therein that open upwardly to the workpiece supporting surface 18 thereof. The grooves include a first groove 36, a second groove 38, a third groove 40, a fourth groove 42, a fifth groove 44, and a sixth groove 46. These grooves extend between and communicate with the first, second, third, fourth, fifth, and sixth sets of aligned slots, respectively.

During a workpiece cutting operation, a workpiece (not shown) is placed on the workpiece supporting surface 18 and an edge of the workpiece is abutted firmly against one of the abutment surfaces 20,22. Then, a saw is placed in a ready to cut position with its saw blade received in each of a desired set of aligned slots. For example, if it is desired to cut the workpiece at 45° with respect to its edge, then the saw blade would be inserted into either the second or fourth set of aligned slots 26,30. Likewise, if it is desired to cut the workpiece at 45° with respect to the surface thereof engaging the workpiece, then the saw blade would be inserted into the sixth set of aligned slots 34. Thereafter, the saw is moved back and forth in a reciprocating motion with the teeth thereof cutting through the workpiece and the selected set of aligned slots cooperating to guide the saw blade and maintain it at the proper angle. The grooves formed in the workpiece supporting surface 18 enable the saw blade to travel below the workpiece supporting surface 18, thereby ensuring that the workpiece is cut through its entire thickness.

A series of openings are formed through the base 12 to allow sawdust and other debris to fall from the workpiece supporting surface 18 and out from the bottom of the box 10. This prevents sawdust and other such debris from building up on the workpiece supporting surface 18. These openings include four relatively large openings 48 and eight relatively small openings 50, each of openings 48,50 being defined between the portions of the base 12 that define the aforementioned grooves.

Figure 3:
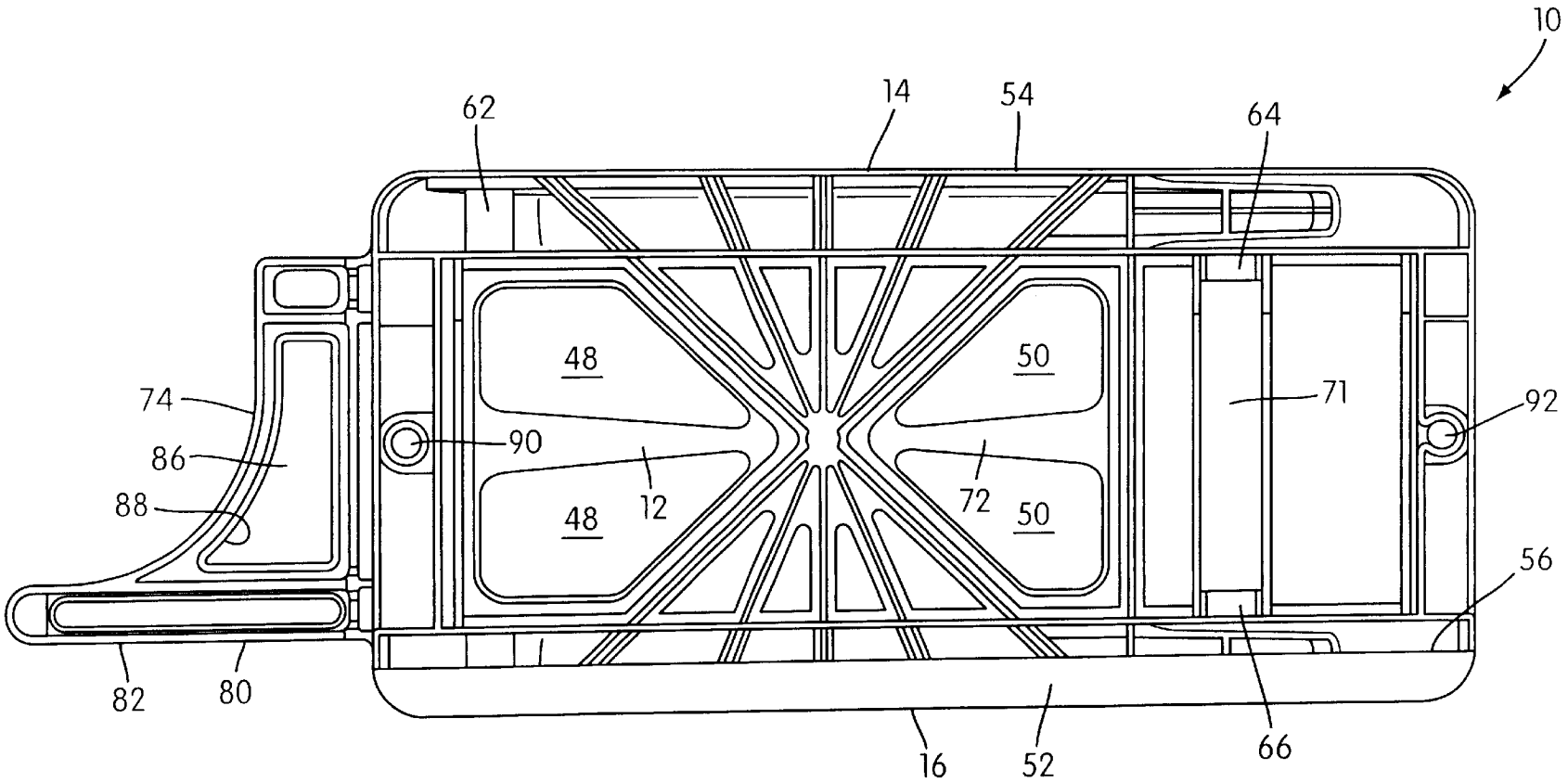
FIG. 3 is a bottom view of the mitre box of FIG. 1.

It should be noted that the entire mitre box 10 has a thin-walled construction and is not made as a solid plastic piece. For example, it can be seen in FIG. 3 that the interiors of the walls 14,16 are mostly hollow with the exception of the portions thereof that define the sets of aligned slots.

The box 10 also has an integrally molded abutment member 52 depending downwardly below the wall 16 and extending beyond the generally planar bottom surface 54 of the box 10. The abutment member 54 provides an abutment surface 56 that extends generally perpendicularly with respect to the bottom surface 54. The abutment member 52 and the abutment surface 56 can be best seen in FIG. 4. This abutment member 52 provides added stability when using the mitre box 10 on a flat workbench surface (not shown). Box 10 is placed on the workbench with the bottom surface 54 engaging the upper surface of the workbench and the abutment surface 56 firmly engaged against an edge of the workbench. This prevents the mitre box 10 from moving during the forward stroke (i.e., the stroke in the direction away from the abutment member 56) of the saw. This is particularly advantageous because the teeth of most saws are usually configured so that they perform must of their cutting on the forward stroke rather than on the back stroke.

Figure 2:
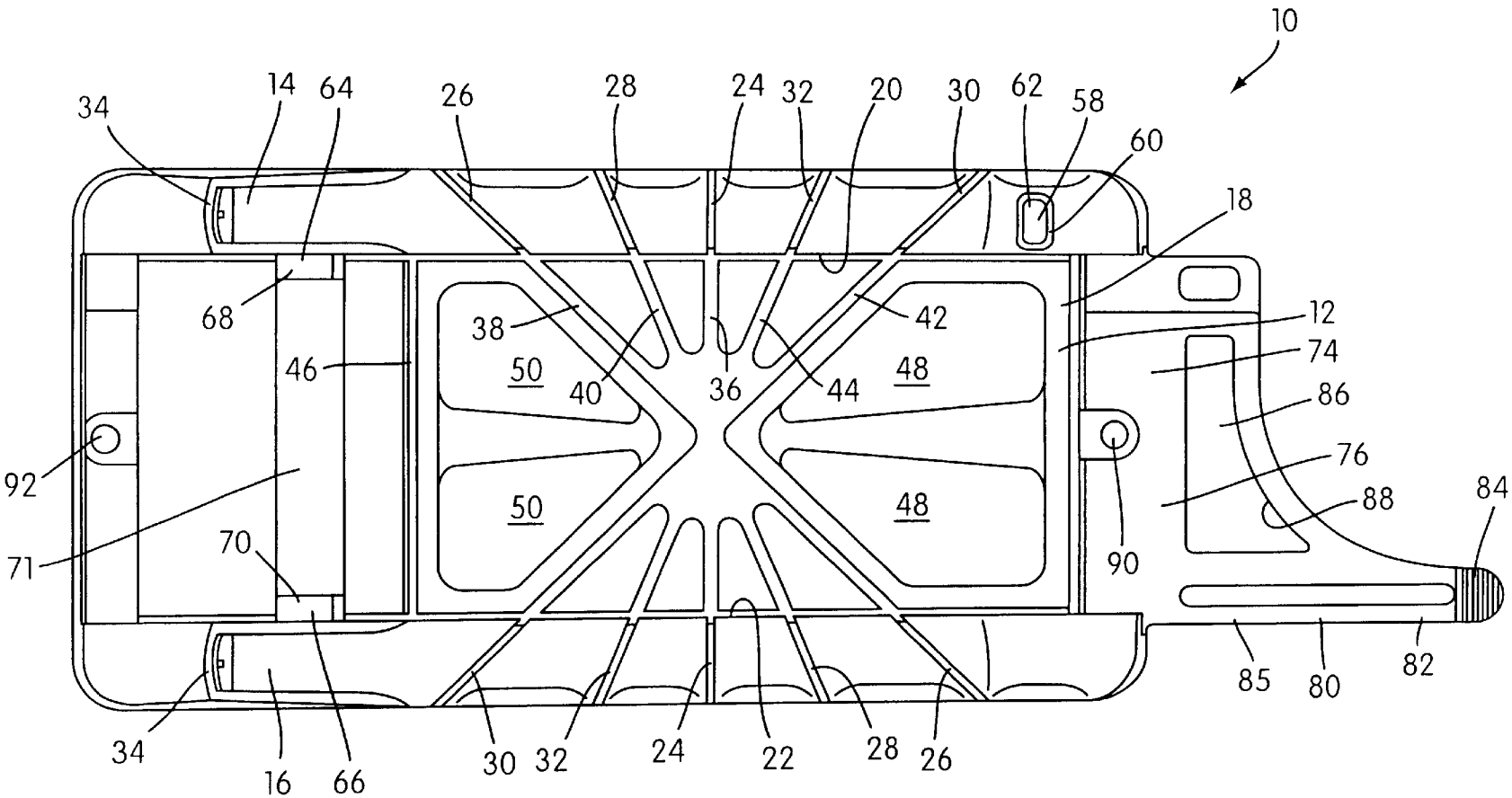
FIG. 2 is a top view of the mitre box of FIG. 1.
Figure 4:
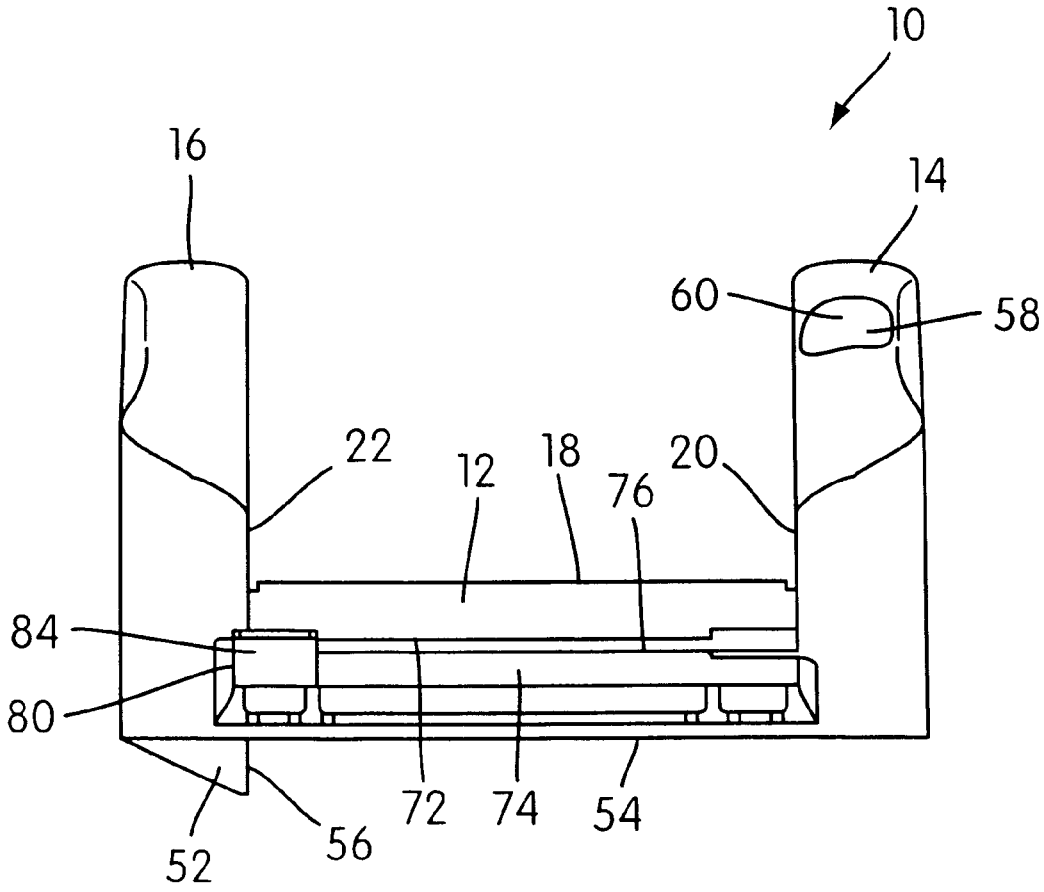
FIG. 4 is an elevational view of the mitre box of FIG. 1 taken from one end thereof.
Figure 5:
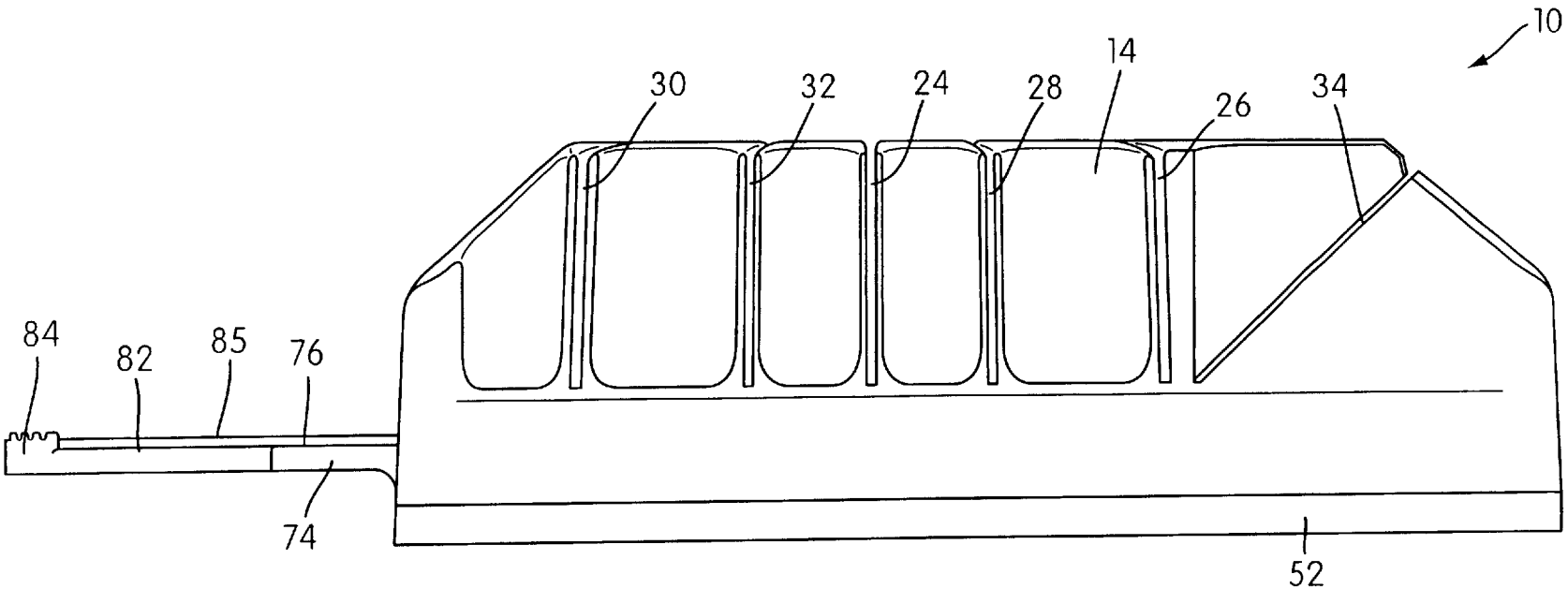
FIG. 5 is an elevational view of the mitre box of FIG. 1 taken from one side thereof.

As best seen in FIGS. 2 and 4, wall 14 has an elongated well 58 that opens generally upwardly. The elongated well 58 is defined by a generally cylindrical wall 60 and a rounded bottom wall 62 and extends to a depth sufficient to enable an elongated marking tool, such as a pen or pencil, to be stored therein in an upright position. This well 58 enables the user to mark the workpiece at the point to be cut, store the marking tool in the well 58, and then align the marking with the appropriate set of aligned slots for performance of the cutting operation described above. For repeated cutting and marking operations, this well 58 is especially advantageous because it provides an easily visible location for storing the marking tool between uses. As a result, misplacing or losing the marking tool can be prevented. This aspect of the invention may be practiced with any type of mitre box and is not limited to the molded plastic one disclosed herein. For example, this aspect of the invention may be practiced with the compound mitre box disclosed in U.S. Pat. No. 3,651,840, the entirety of which is hereby incorporated into the present application by reference. With the arrangement disclosed in the '840 patent, there is only one slot that guides movement of the saw and this slot can be reoriented to selected angles. Thus, the term saw guiding structure may be used to broadly cover any type of structure suitable for guiding a saw at its selected cutting angle, whether the saw guiding structure be of the type illustrated in the Figures of the present application or of the type shown in the '840 patent.

Extending inwardly from the side walls 14,16 and spaced below the base 12 is a pair of saw supporting tabs 64,66 that provide generally upwardly facing saw supporting surfaces 68,70. These tabs 64,66 are formed integrally with side walls 14,16. As can be appreciated from FIG. 2, these tabs 64,66 can be seen from above via the large rectangular opening 71 formed through the base 12. This opening 71 is used so that the tabs 64,66 can be formed without the need for overly complex mold inserts. In addition, this opening 71 also allows sawdust and other debris to fall off the supporting surface 18 and out the bottom of the box 10.

As can be best appreciated from FIG. 1, the tabs 64,66 are spaced below the bottom surface 72 of the base 12 with the saw supporting surfaces 68,70 thereof facing generally upwardly. At the end of the box 10 opposite the tabs 64,66 is an integrally molded saw supporting member 74 that provides a saw supporting surface 76 extending between the walls 14,16. The saw supporting surface 76 extends in generally the same plane as the saw supporting surfaces 68,70. As a result, a saw can be temporarily stored within the box 10 between cutting operations by inserting it between the base 12 and the saw supporting surfaces 68,70,76. In this condition, the saw supporting surfaces 68,70,76 support the saw blade below the base 12 and one of the walls 14,16 (whichever one the saw teeth are facing) shields the teeth of the saw to prevent persons from accidentally cutting themselves.

In a broad sense, the tabs 64,66 and the member 72 may be considered integrally molded storage space defining structures that define a space for temporarily storing the saw below the base 12 and provide upwardly facing saw support surfaces for supporting the saw.

Figure 6:
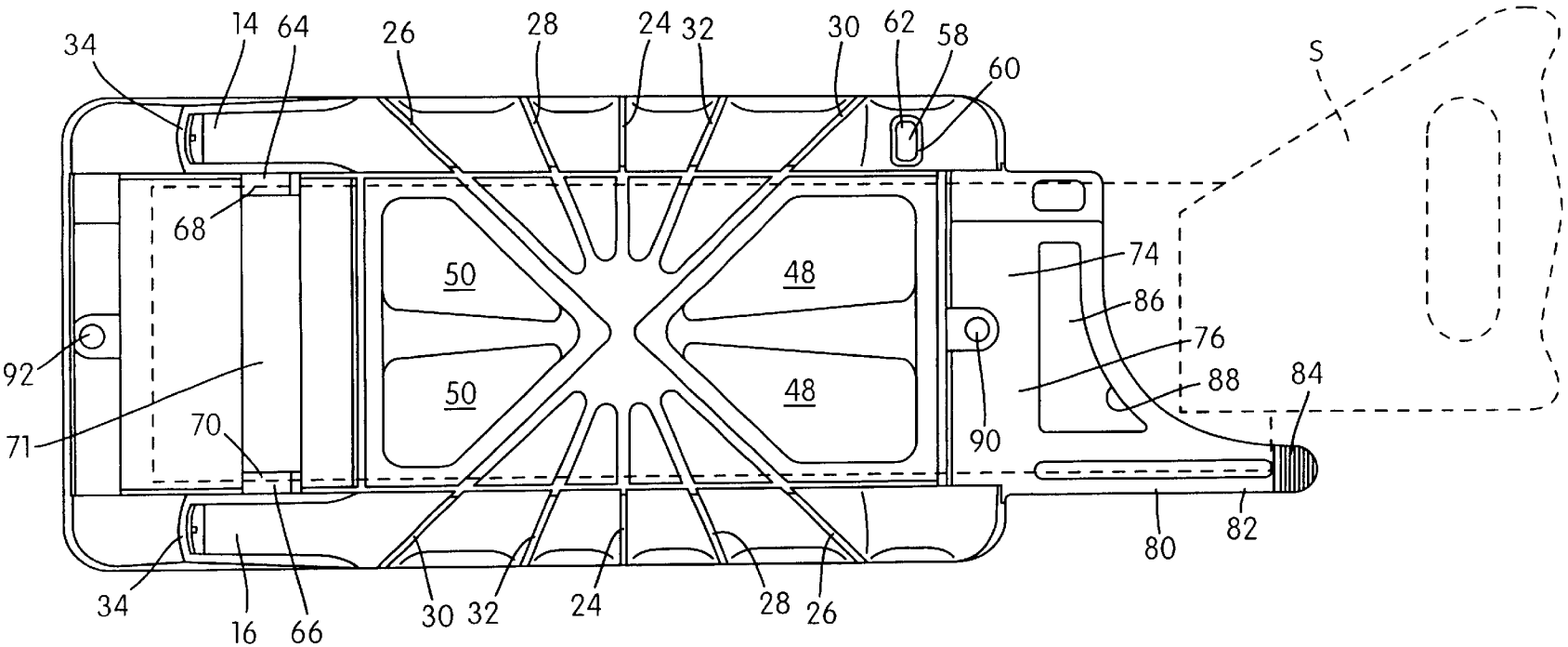
FIG. 6 is a top view similar to FIG. 2 with the saw temporarily stored in the storage space of the box, the saw hereby shown in phantom.

The saw supporting member 74 has an integrally molded releasable locking member 80 that functions to keep a saw stored in the storage space from falling out of the box 10. The locking member 80 has an elongated arm 82 that is somewhat flexible as a result of being plastic and a tab 84 (i.e., a saw retaining structure) protruding upwardly from the arm's free end. When a saw is stored in the storage space supported by the saw supporting surfaces 68, 70, 76, the tab 84 engages the outer edge of the saw's blade to retain it against outward movement from the storage space. This is shown in FIG. 6 wherein the saw is shown in phantom outline and indicated at S. To remove the saw S, the tab 84 is depressed downwardly against the bias of the arm 82 so as to be moved below the outer edge of the saw blade, thereby releasing the saw S for removal (a releasing position). The resiliency of the plastic material forming the arm 82 normally keeps the arm in the position shown in the Figures whereat it will engage the saw S and retain the same in the storage space (a retaining position). When the tab 84 is depressed downwardly, the arm flexes downwardly and applies an upward biasing force in reaction to such downward movement. Thus, the arm may be considered to function as a biasing element that functions to bias the tab 84 away from its releasing position and towards its retaining position absent downward force moving the tab towards its releasing position. This aspect of the invention may be practiced on other mitre boxes, such as the one shown in the above-incorporated '840 patent.

The arm 82 has a lip 85 formed on the outer edge thereof. This lip 85 protrudes slightly above the arm 82 (the surface of which provides some support to the saw blade) so as to protect the teeth of the saw blade from exposure. This prevents cuts and scratches from accidental contact with the saw teeth.

An opening 86 is formed through the saw supporting member 74. This opening allows the user to easily carry or hang the box 10 when the saw is removed therefrom.

A circular hole 90 is also formed through the saw supporting member 74. A circular hole 92 is also formed through the base 12 at the end thereof opposite member 74. These circular holes 90, 92 allows the box 10 to be hung on a nail, screw or the like when not being used. In addition, these holes 90, 92 allow the user to insert fasteners therethrough to secure the box 10 to a worktable or other flat supporting surface. This provides for optimum stability and frees up the user's hands because there is no need to manually hold down the box during cutting.

It can thus be appreciated that the objects of the present invention have been fully and effectively accomplished. It is to be understood, however, that the foregoing preferred embodiment has been provided solely to illustrate the structural and functional principle of the present invention and is not intended to be limiting. To the contrary, the principles of the present invention are intended to encompass all modifications, alterations, and substitutions within the spirit and scope of the appended claims.

What is claimed:

1. A molded plastic mitre box for use in conjunction with a saw having a pair of opposed major faces and a cutting edge during the cutting operation wherein a cutting edge of the saw is engaged with the workpiece and moved through a series of cutting strokes to cut into the workpiece, said mitre box comprising:

a molded plastic base having a workpiece supporting surface constructed and arranged to support the workpiece during the aforesaid cutting operation;

said molded plastic base including integrally molded structure that defines a generally upwardly facing saw supporting surface and a storage space extending below the workpiece supporting surface of said base, said storage space and said saw supporting surface being configured to enable the saw to be temporarily stored beneath said workpiece supporting surface in said storage space and supported by said saw supporting surface with the opposed major faces of the saw in generally parallel relation to said workpiece supporting surface between cutting operations;

a first molded plastic slot defining structure having a saw receiving slot extending through a thickness of said first slot defining structure, said saw receiving slot having a width suitable for receiving the saw and guiding the saw as it is moved through the series of cutting strokes during the aforesaid cutting operation;

a second molded plastic slot defining structure having a saw receiving slot extending through a thickness of said second slot defining structure and being substantially aligned with a saw receiving slot of said first slot defining structure, said saw receiving slot of said second slot defining structure having a width suitable for receiving the saw and guiding the saw as it is moved through the series of cutting strokes during the aforesaid cutting operation;

a molded plastic abutment structure providing a workpiece edge abutting surface, said abutment structure being constructed and arranged with respect to said slot defining structures to enable the workpiece to be placed on the workpiece supporting surface an edge of the workpiece abutted against the workpiece abutting surface such that the saw receiving slots of said slot defining structures extend at an angle with respect to the abutted edge of the workpiece;

said abutment structure and said slot defining structures being constructed and arranged to enable the aforesaid cutting operation to be performed when the workpiece is placed on the workpiece supporting surface with the edge of the workpiece abutting the workpiece edge abutting surface by (a) removing the saw from said storage space, (b) then inserting the saw into the substantially aligned saw receiving slots so that a cutting portion of the saw is engaged with the workpiece and extends at the angle determined by the substantially aligned saw receiving slots with respect to the edge of the workpiece, and (c) then moving the saw through a series of cutting strokes with the substantially aligned saw receiving slots guiding the saw through its cutting strokes so that cutting edge of the saw cuts into the workpiece at the aforesaid selected angle.

2. A mitre box according to claim 1, wherein said first and second slot defining structures are first and second generally parallel walls, respectively, and wherein a portion of said first wall provides said workpiece abutting structure.

3. A mitre box according to claim 1, wherein said base, said slot defining structures, and said abutment structure are molded as a unitary piece.

4. A mitre box according to claim 1, wherein said storage space has an opening that allows for insertion and removal of the saw into and from said storage space, and wherein said mitre box further comprises:

a releasable saw retainer proximate the opening of said saw storage space, said saw retainer being constructed and arranged such that, when the saw is temporarily stored in the storage space, said saw retainer engages the saw so as to releasably retain the saw in said storage space in such a manner to allow the saw and box to be carried together by manually grasping the saw handle, said saw retainer being constructed and arranged such that, when the saw is temporarily stored in said storage space and it is desired to remove the saw therefrom, said saw retainer can be moved to a releasing position wherein said saw retainer is disengaged from the saw so as to permit removal of the saw from said storage space through said opening.

5. A mitre box according to claim 1, wherein said saw supporting surface is provided by a structure extending below said storage space and across a width of said storage space.

6. A mitre box according to claim 5, wherein the structure providing said saw supporting surface also extends a length of said storage space.

7. A mitre box according to claim 6, wherein the structure providing said saw supporting surface comprises a plurality of members arranged below said storage space and along the width and length of said storage space.

8. A mitre box for use in conjunction with a saw having a pair of opposed major faces and a cutting edge during a cutting operation wherein the cutting edge of the saw is engaged with the workpiece and moved through a series of cutting strokes to cut into the workpiece, said mitre box comprising:

a base having a workpiece supporting surface constructed and arranged to support the workpiece during the aforesaid cutting operation;

said base providing a generally upwardly facing saw supporting surface and a storage space extending below the workpiece supporting surface of said base, said storage space and said saw supporting surface being configured to enable the saw to be temporarily stored beneath said workpiece supporting surface in said storage space and supported by said saw supporting surface with the opposed major forces of the saw in generally parallel relation to said workpiece supporting surface between cutting operations;

an abutment structure providing a workpiece edge abutting surface, said abutment structure being constructed and arranged such that the workpiece can be placed on the workpiece supporting surface and an edge of the workpiece can be abutted against the workpiece abutting surface;

saw guiding structure having saw guiding surfaces, said saw guiding structure being constructed and arranged such that, when the workpiece is placed on the workpiece supporting surface with the edge thereof abutted against the workpiece abutting surface, the aforesaid workpiece cutting operation can be performed by (a) inserting the saw between the saw guiding surfaces of said saw guiding structure so that the cutting edge of the saw is engaged with the workpiece and extends at the angle determined by the saw guiding surfaces with respect to the edge of the workpiece, and (b) then moving the saw through a series of cutting strokes with the saw guiding surfaces guiding the saw through its cutting strokes so that the cutting edge of the saw cuts into the workpiece at the aforesaid selected angle.

9. A mitre box according to claim 8, wherein said saw supporting surface is provided by a structure extending below said storage space and across a width of said storage space.

10. A mitre box according to claim 9, wherein the structure providing said saw supporting surface also extends a length of said storage space.

11. A mitre box according to claim 10, wherein the structure providing said saw supporting surface comprises a plurality of members arranged below said storage space and along the width and length of said storage space.

12. A mitre box according to claim 8, wherein said saw guiding structure comprises:

a first slot defining structure having a saw receiving slot extending through a thickness of said first slot defining structure, said saw receiving slot of said first slot defining structure having a width suitable for receiving the saw and guiding the saw as it is moved through the series of cutting strokes during the aforesaid cutting operation;

a second slot defining structure having a saw receiving slot extending through a thickness of said second slot defining structure and being substantially aligned with the saw receiving slot of said first slot defining structure, said saw receiving slot of said second slot defining structure having a width suitable for receiving the saw and guiding the saw as it is moved through the series of cutting strokes during the aforesaid cutting operation, said first and second slots providing interior surfaces that define said saw guiding surfaces.

13. A mitre box according to claim 12, wherein the entire mitre box is molded from plastic.

14. A mitre box according to claim 13, wherein the entire mitre box is injection molded.

15. A mitre box according to claim 12, wherein said first and second slot defining structures are first and second generally parallel walls, respectively, and wherein a portion of said first wall provides said workpiece abutting structure.

16. A mitre box according to claim 8, wherein said storage space has an opening that allows for insertion and removal of the saw into and from said storage space, and wherein said mitre box further comprises:

a releasable saw retainer associated with the opening of said saw storage space, said saw retainer being constructed and arranged such that, when the saw is temporarily stored in the storage space, said saw retainer engages the saw so as to releasably retain the saw in said storage space in such a manner to allow the saw and box to be carried together by manually grasping the saw handle, said saw retainer being constructed and arranged such that, when the saw is temporarily stored in said storage space and it is desired to remove the saw therefrom, said saw retainer can be moved to a releasing position wherein said saw retainer is disengaged from the saw so as to permit removal of the saw from said storage space through said opening.

* * * * *